US008876665B1

(12) United States Patent
Isom

(10) Patent No.: US 8,876,665 B1
(45) Date of Patent: Nov. 4, 2014

(54) NECK EXERCISE MACHINE FOR STANDING USE

(75) Inventor: Larry H. Isom, Panora, IA (US)

(73) Assignee: Conner Athletic Products, Jefferson, IA (US)

( * ) Notice: Subject to any disclaimer, the term of this patent is extended or adjusted under 35 U.S.C. 154(b) by 145 days.

(21) Appl. No.: 13/460,097

(22) Filed: Apr. 30, 2012

(51) Int. Cl.
*A63B 23/025* (2006.01)
*A63B 21/06* (2006.01)
*A63B 21/062* (2006.01)

(52) U.S. Cl.
USPC ..... 482/10; 482/93; 482/100

(58) Field of Classification Search
USPC ..... 482/10, 92–94, 97–101, 133–137, 139, 482/142
See application file for complete search history.

(56) References Cited

U.S. PATENT DOCUMENTS 3,640,527 A * 2/1972 Proctor ..... 482/100
4,278,249 A * 7/1981 Forrest ..... 482/10
4,645,198 A * 2/1987 Levenston ..... 482/10
4,768,779 A * 9/1988 Oehman et al. ..... 482/10
5,554,089 A * 9/1996 Jones ..... 482/97
5,722,921 A * 3/1998 Simonson ..... 482/100
5,762,585 A * 6/1998 Jones et al. ..... 482/8
5,984,836 A * 11/1999 Casali ..... 482/10
6,312,365 B1 * 11/2001 Koenig ..... 482/97
6,764,429 B1 * 7/2004 Michalow ..... 482/51
7,104,926 B2 * 9/2006 Carlson ..... 482/10
7,468,019 B2 12/2008 Zylstra
7,670,269 B2 * 3/2010 Webber et al. ..... 482/94
7,815,552 B2 * 10/2010 Dibble et al. ..... 482/92
8,038,588 B2 * 10/2011 Hobson et al. ..... 482/142
8,328,697 B2 * 12/2012 Farbshteyn ..... 482/100
8,702,573 B2 * 4/2014 Hockridge et al. ..... 482/100
2002/0045520 A1 * 4/2002 Lapcevic ..... 482/97
2002/0107116 A1 * 8/2002 Schulz ..... 482/97
2006/0160676 A1 * 7/2006 Sato ..... 482/94
2007/0161470 A1 * 7/2007 Berryman ..... 482/94
2008/0176722 A1 * 7/2008 Steffee ..... 482/98
2010/0120590 A1 * 5/2010 Inaizumi ..... 482/99
2010/0240504 A1 * 9/2010 Hobson et al. ..... 482/94

OTHER PUBLICATIONS

Connor Athletic Products Sit Down Neck Machine, retrieved from the Internet: www.power-lift.com, Apr. 16, 2012 (1 page).

* cited by examiner

*Primary Examiner* — Stephen Crow
*Assistant Examiner* — Garrett Atkinson
(74) *Attorney, Agent, or Firm* — McKee, Voorhees & Sease

(57) ABSTRACT

A neck exercise machine is provided for standing use. The machine has a head pad which can be vertically adjusted to accommodate different user heights. The head pad is mounted on an arm, which is pivotally connected to the machine frame for movement about a first horizontal axis, so that the arm and head pad can be raised and lowered, and then locked in place for use. The head pad is connected to a cam for rotation about a second horizontal axis in use, with selected resistance.

21 Claims, 11 Drawing Sheets

NECK EXERCISE MACHINE FOR STANDING USE

BACKGROUND OF THE INVENTION

Exercise equipment has become specialized to focus on specific muscles. Exercise machines are well known for strengthening the neck. Some prior art neck exercise machines are used while the person is sitting down. However, such a sitting position exercise machine does not effectively work the user's core body muscles during the neck exercise. Such sitting machines typically include an adjustable seat so as to accommodate different sized users. Other neck exercise machines are used while the person is standing, rather than sitting. These prior art neck exercise machines for stand up use usually include an adjustable post to raise and lower the head piece, as well as the weights or resistance mechanism, to accommodate different height users. However, a vertical adjustment of the head gear is sometimes difficult, since most of the structure above the base is raised, rather than only the head pad. Also, the telescoping post members make adjustment more difficult due to friction, or require periodic lubrication to maintain easy telescoping adjustment.

Accordingly, a primary objective of the present invention is the provision of an improved neck exercising machine for use by a person in a standing position.

Another objective of the present invention is the provision of a neck exercise machine for stand up use, with a head pad which is easily adjustable to the height of the user.

A further objective of the present invention is the provision of a neck exercise machine wherein the vertical position of the head pad can be quickly and easily adjusted without moving the resistance force.

Still another objective of the present invention is the provision of a neck exercise machine wherein the head pad is mounted to a pivotal arm which is rotated about a horizontal axis for height adjustment of the head pad.

A further objective of the present invention is the provision of an improved neck exercise machine for standing use when the head pad can be selectively positioned at multiple heights.

Another objective of the present invention is the provision of an improved neck exercise machine which is economical to manufacture, and durable and safe in use.

There and other objectives will become apparent from the following description of the invention.

SUMMARY OF THE INVENTION

The neck exercise machine of the present invention includes a base or frame with one or more resistance members, such as weight plates, which provide a selective resistance force during use. A head pad is pivotal about first horizontal axis to exercise a user's neck while the user is in a standing position, with selected resistance from the weights or other resistance member. The head pad is also mounted on an arm pivotally connected to the frame of the machine. The angular position of the arm can be selectively adjusted so as to raise and lower the head pad to accommodate users having different heights. In an alternative embodiment, the head pad can be raised vertically. The adjustment of the head pad position is done without moving the resistance force. A lock assembly, including a pin positioned in one of a plurality of holes in a plate attached to the frame maintains the head pad at the selected vertical height for a specific user.

DETAILED DESCRIPTION OF THE PREFERRED EMBODIMENTS

Figure 1:
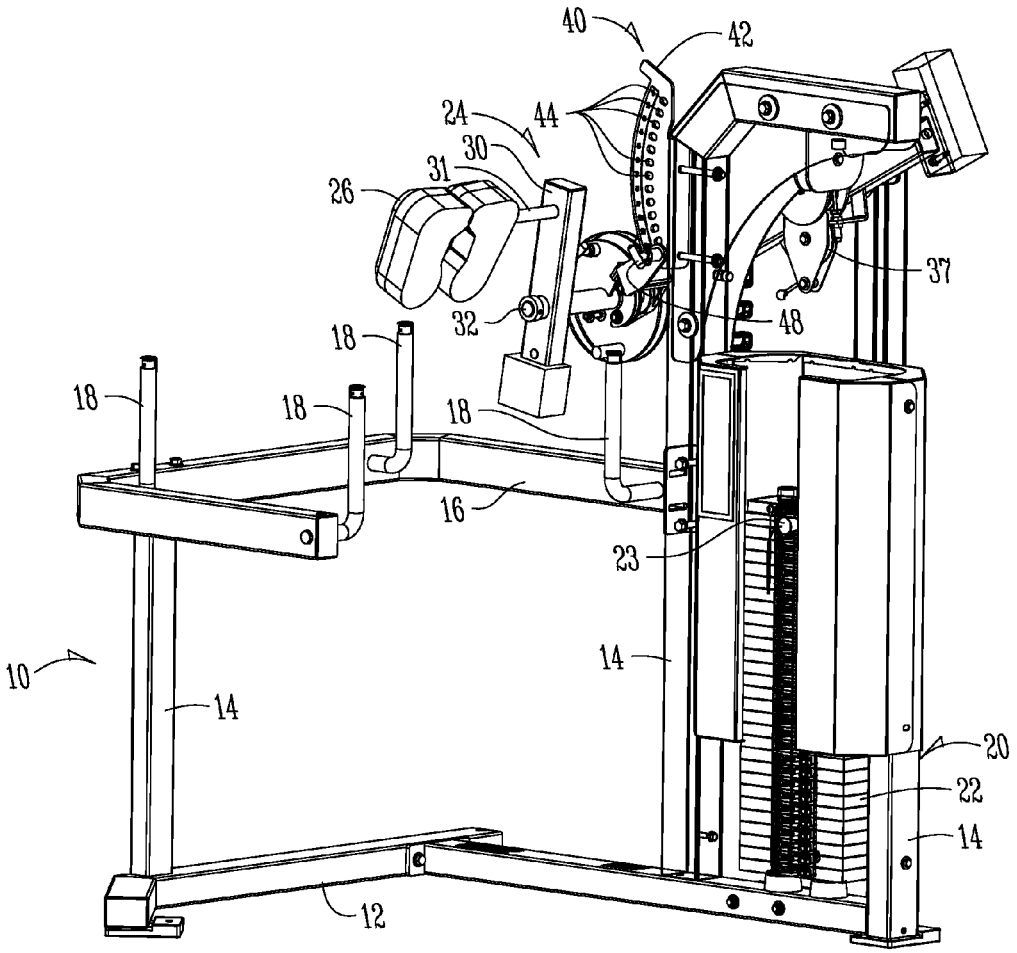
FIG. 1 is a perspective view of the improved neck exercise machine of the present invention, with the head pad set at its lowermost position.
Figure 2:
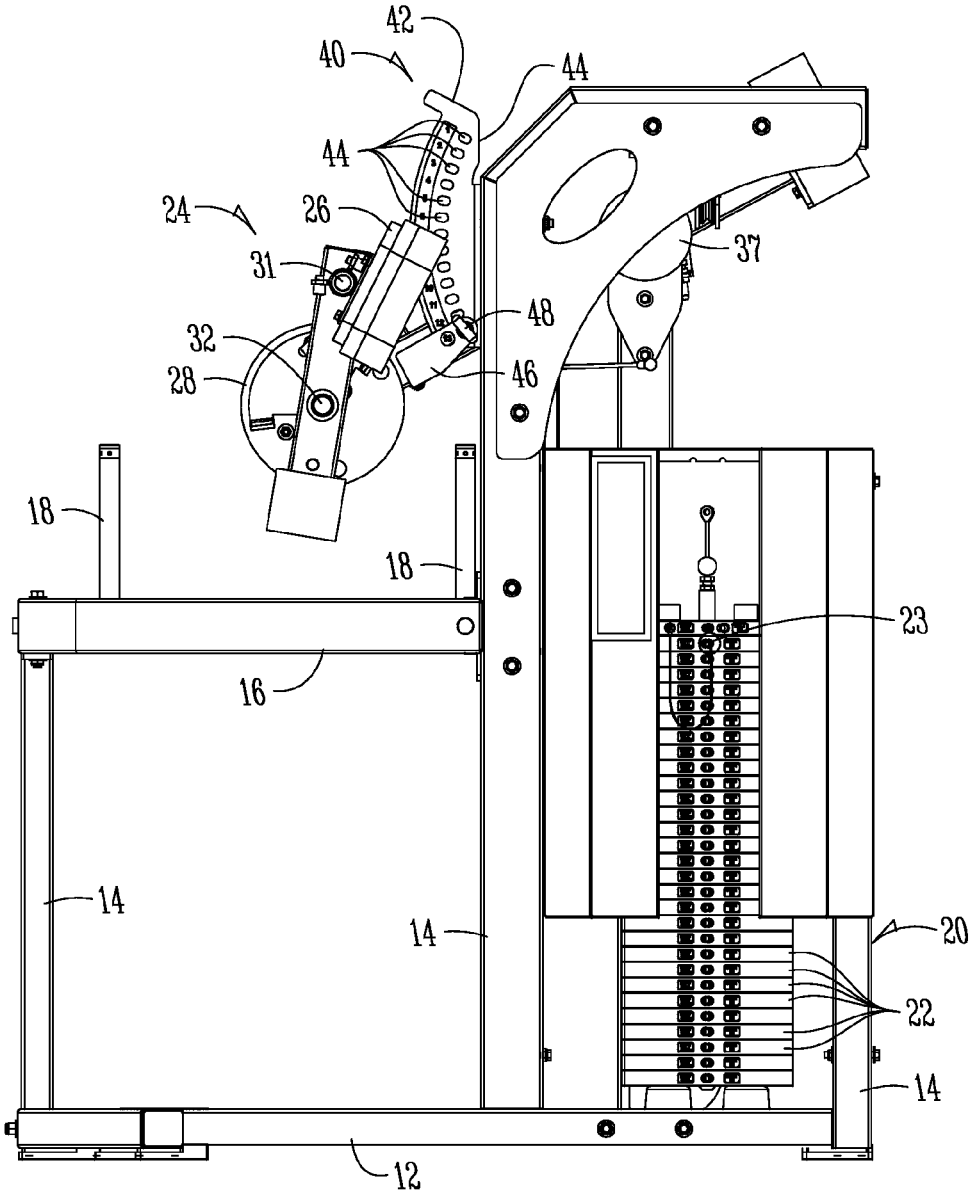
FIG. 2 is a side elevation view of the machine, with the head pad at the lowest position.
Figure 3:
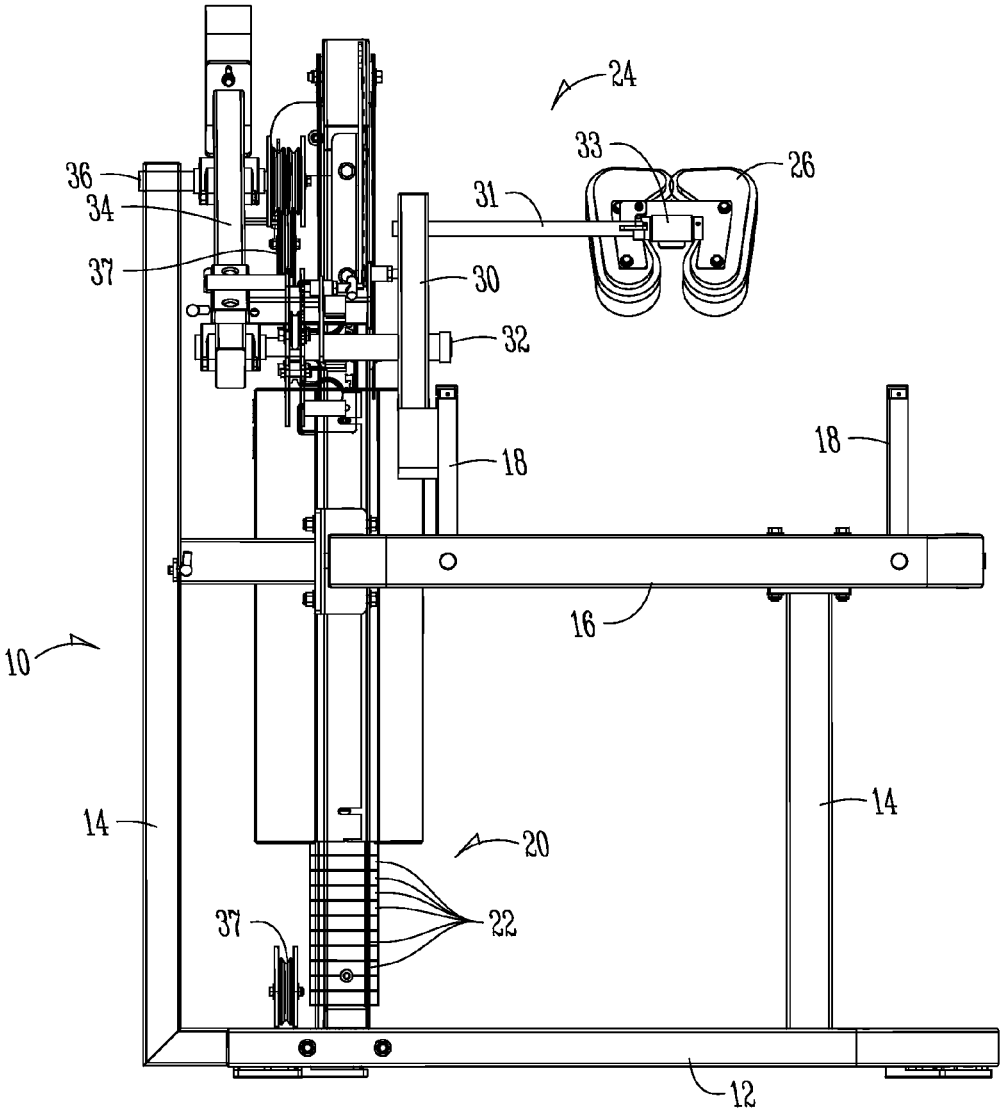
FIG. 3 is a rear elevation view of the machine, with the head pad at the lowest position.

The neck exercise machine of the present invention is generally designated by the reference numeral 10 in the drawings. The machine 10 includes a base 12 which sits upon the floor. Posts 14 extend upwardly from the base 12. A horizontal u-shaped member 16 is supported by the posts. A plurality of hand grips 18 are secured to the horizontal member 16. Together, the base 12, posts 14 and member 16 define a frame for the machine 10.

The machine 10 also includes a resistance assembly 20 which allows the user to select the amount of resistance during various neck exercises. As seen in the drawings, in the preferred embodiment, the resistance force is provided by a plurality of weight plates 22, which slide along one or more guide posts or tracks, as is known in the art. The amount of weight is selected by a pin 23 removably inserted through the weight plates 22, as is known in the art. Other types of resistance may be substituted for the weight plates, such as elastic bands, a cylinder with an extendable and retractable arm, springs, or other known resistance mechanisms.

Figure 4:
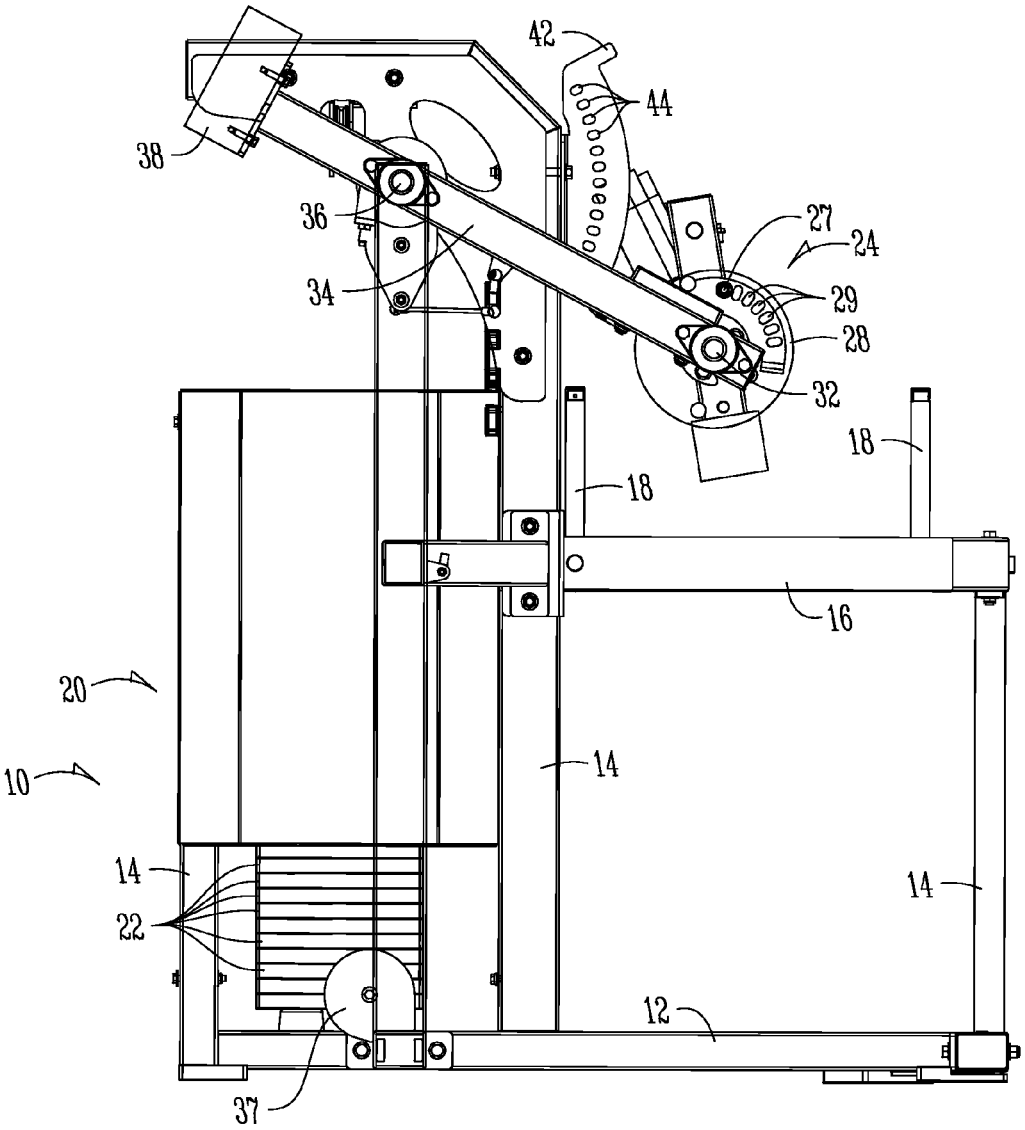
FIG. 4 is a side elevation view of the machine from the opposite side as FIG. 2, with the head pad at the lowest position.
Figure 5:
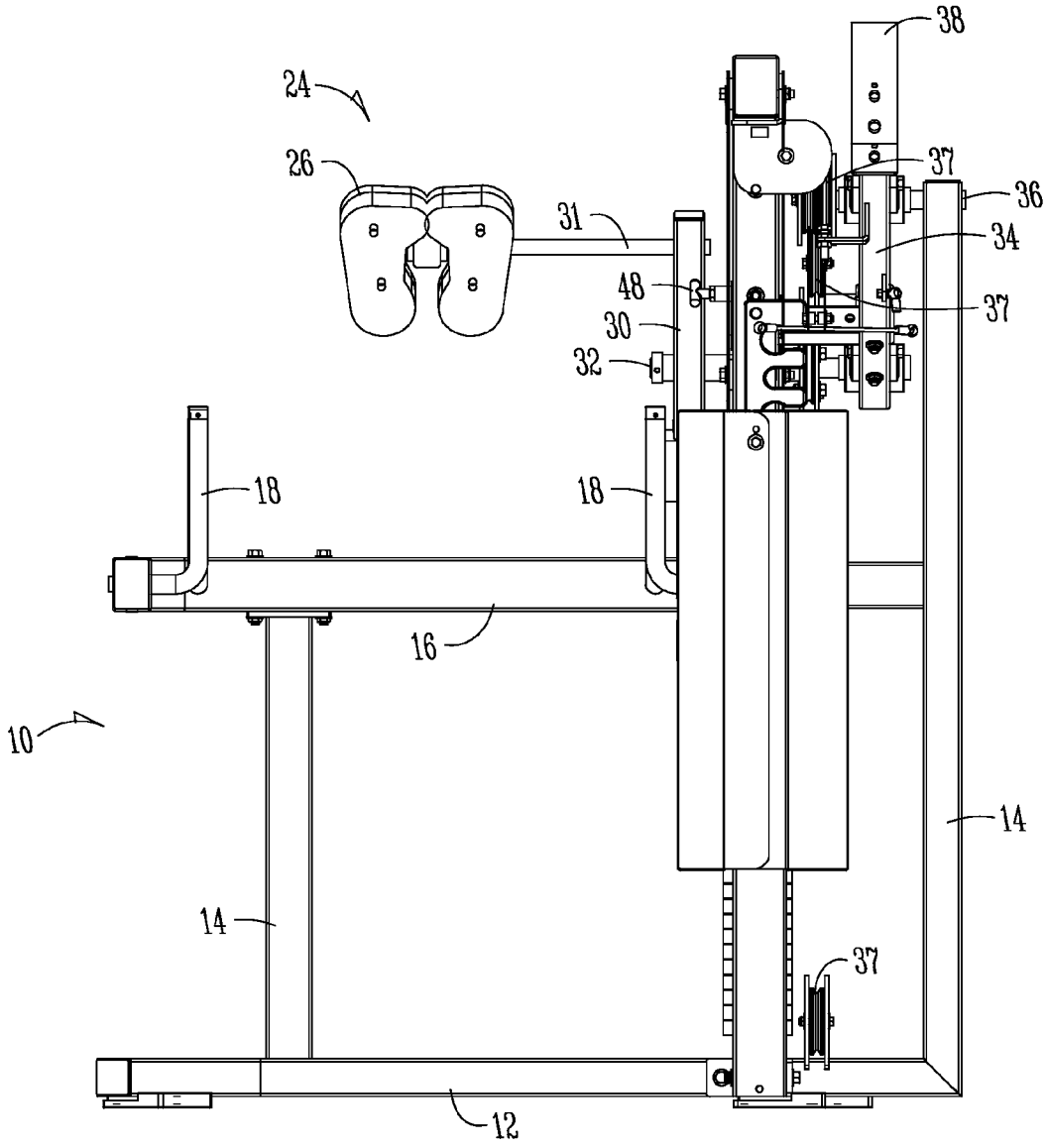
FIG. 5 is a front elevation view of the machine, with the head pad at the lowest position.
Figure 6:
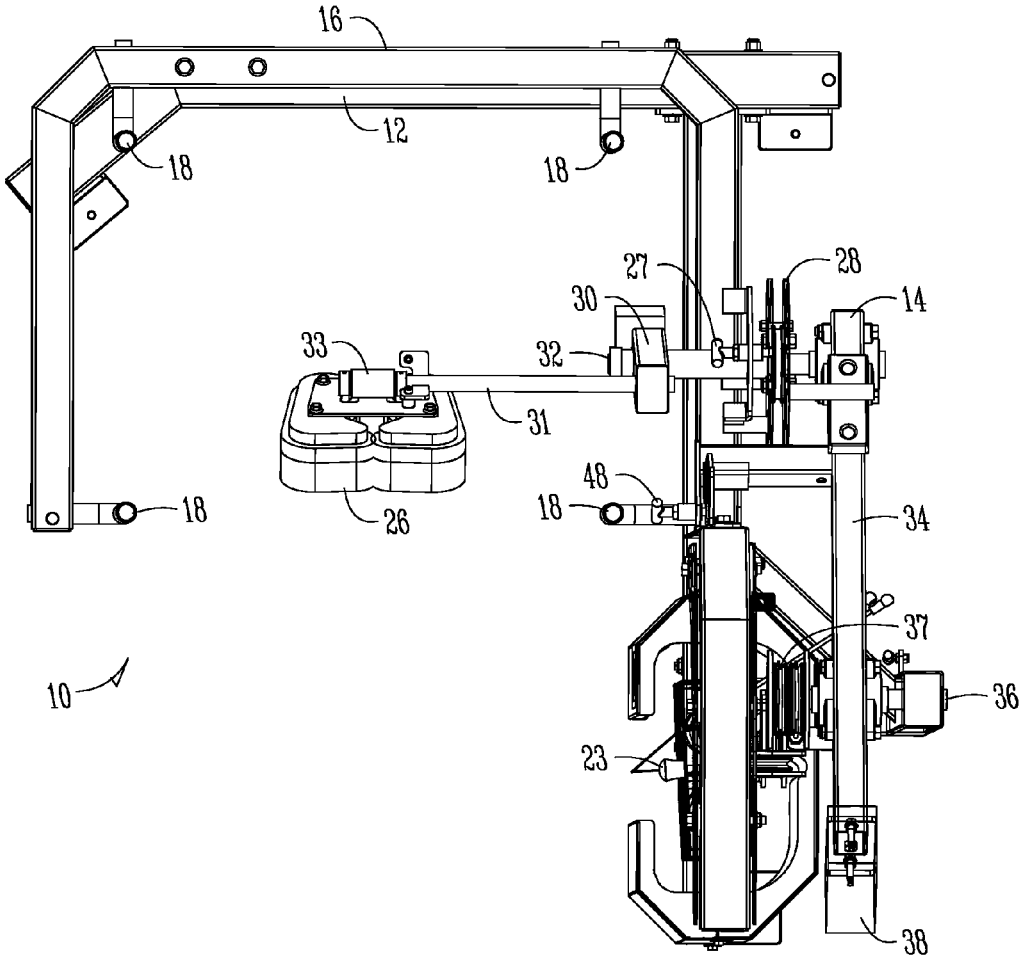
FIG. 6 is a top elevation view of the machine, with the head pad at the lowest position.
Figure 7:
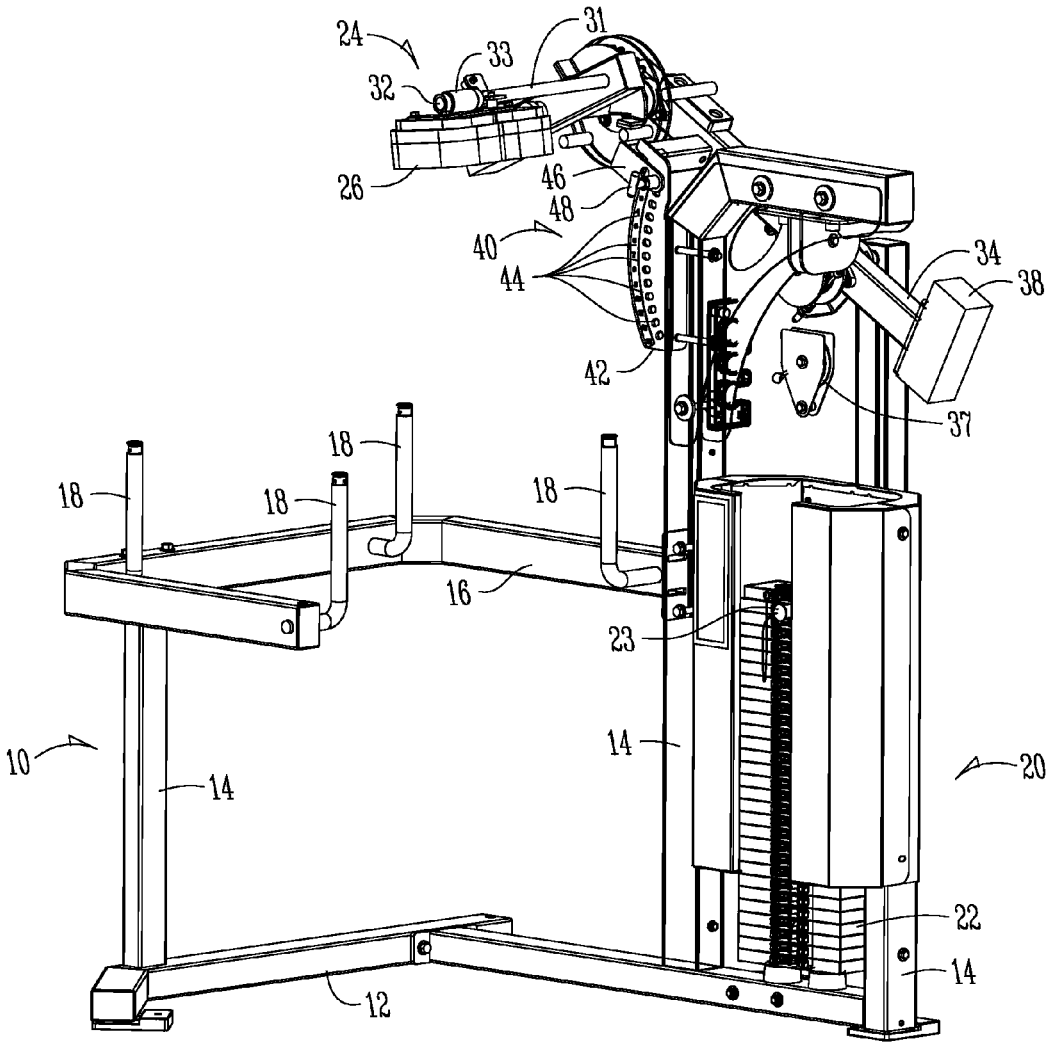
FIG. 7 is a perspective view of the neck exercise machine of the present invention, with the head pad at its highest position.
Figure 8:
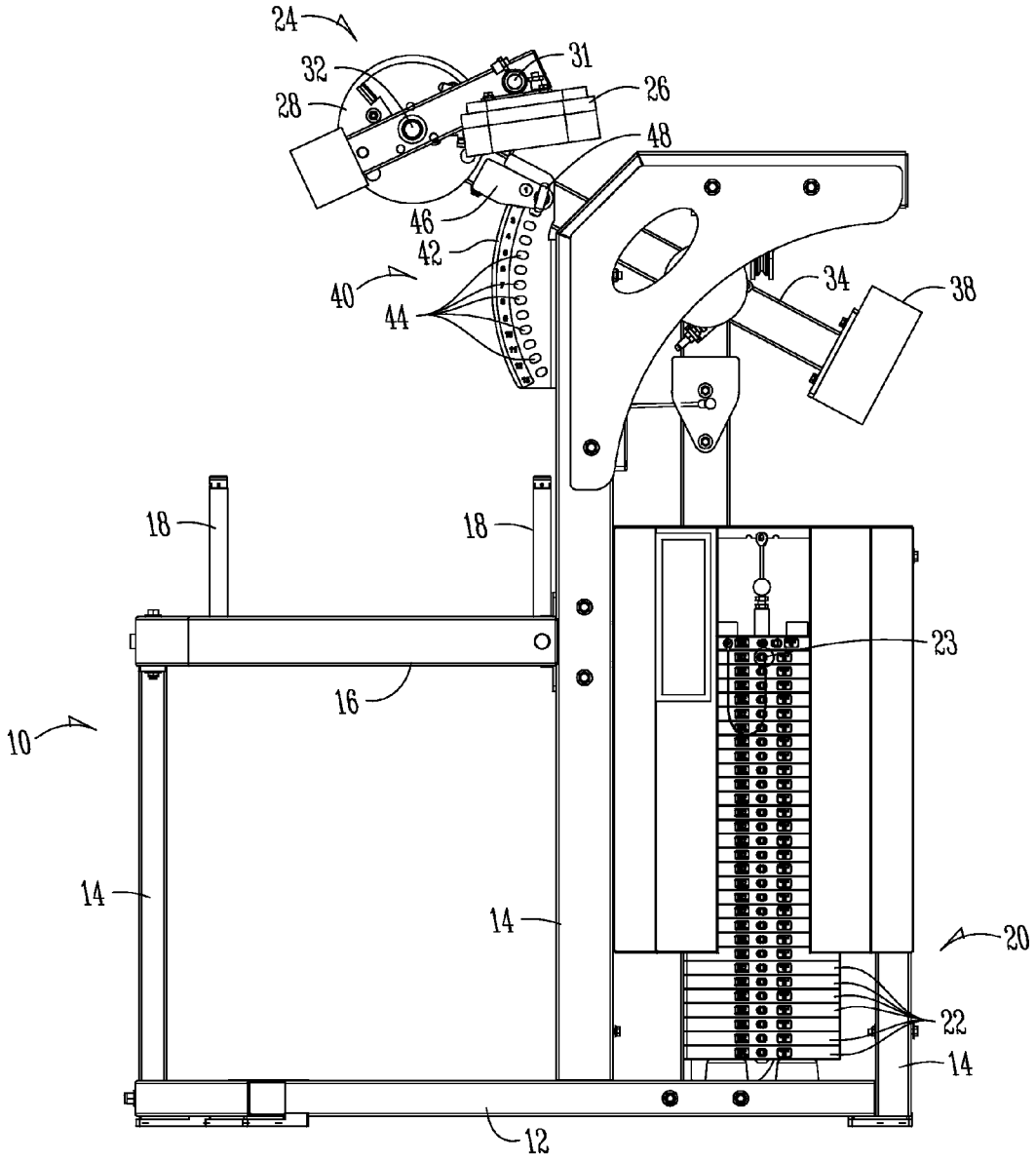
FIG. 8 is a side elevation view similar to FIG. 2, with the head pad at the highest position.
Figure 9:
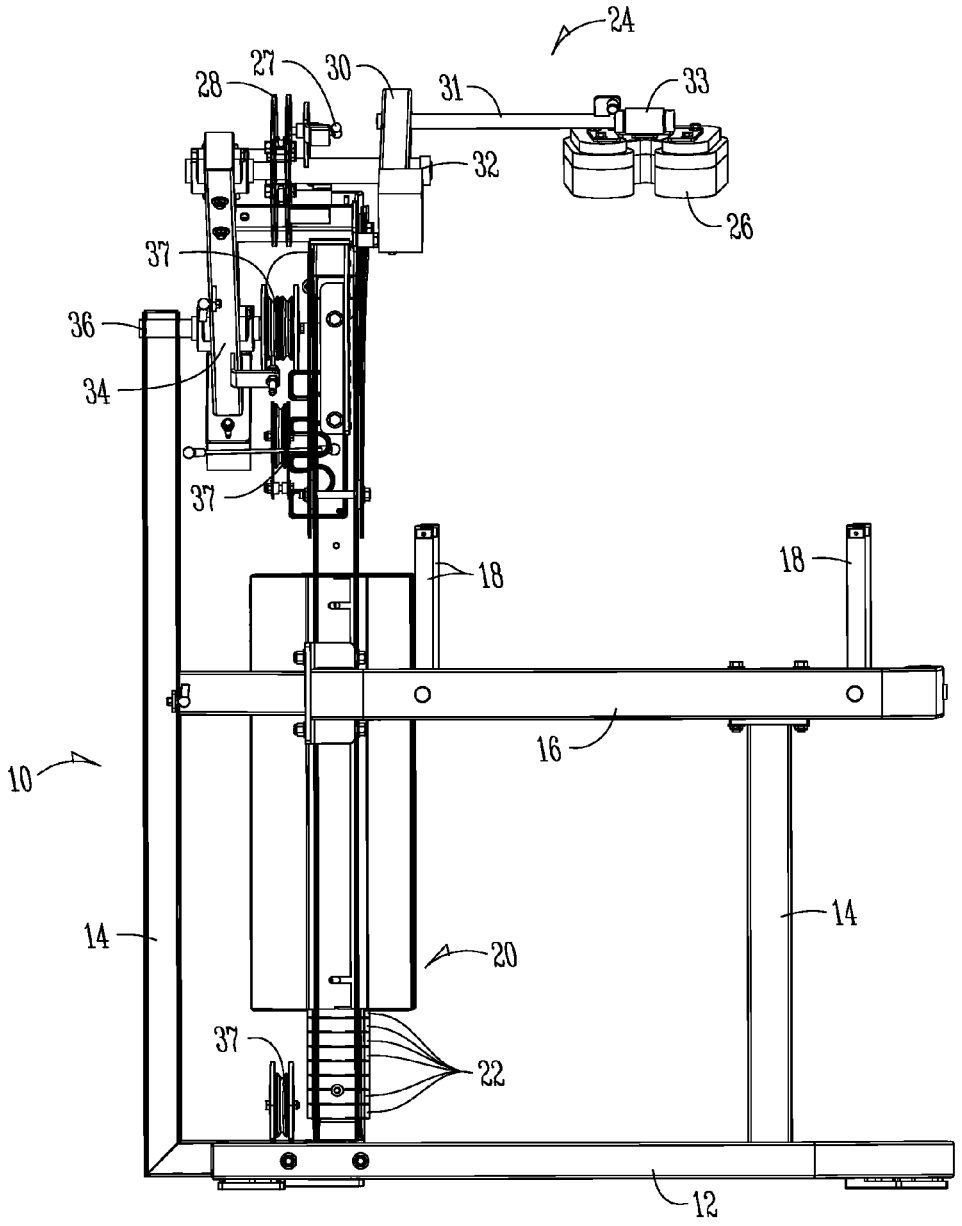
FIG. 9 is a rear elevation view similar to FIG. 3, with the head pad at the highest position.
Figure 10:
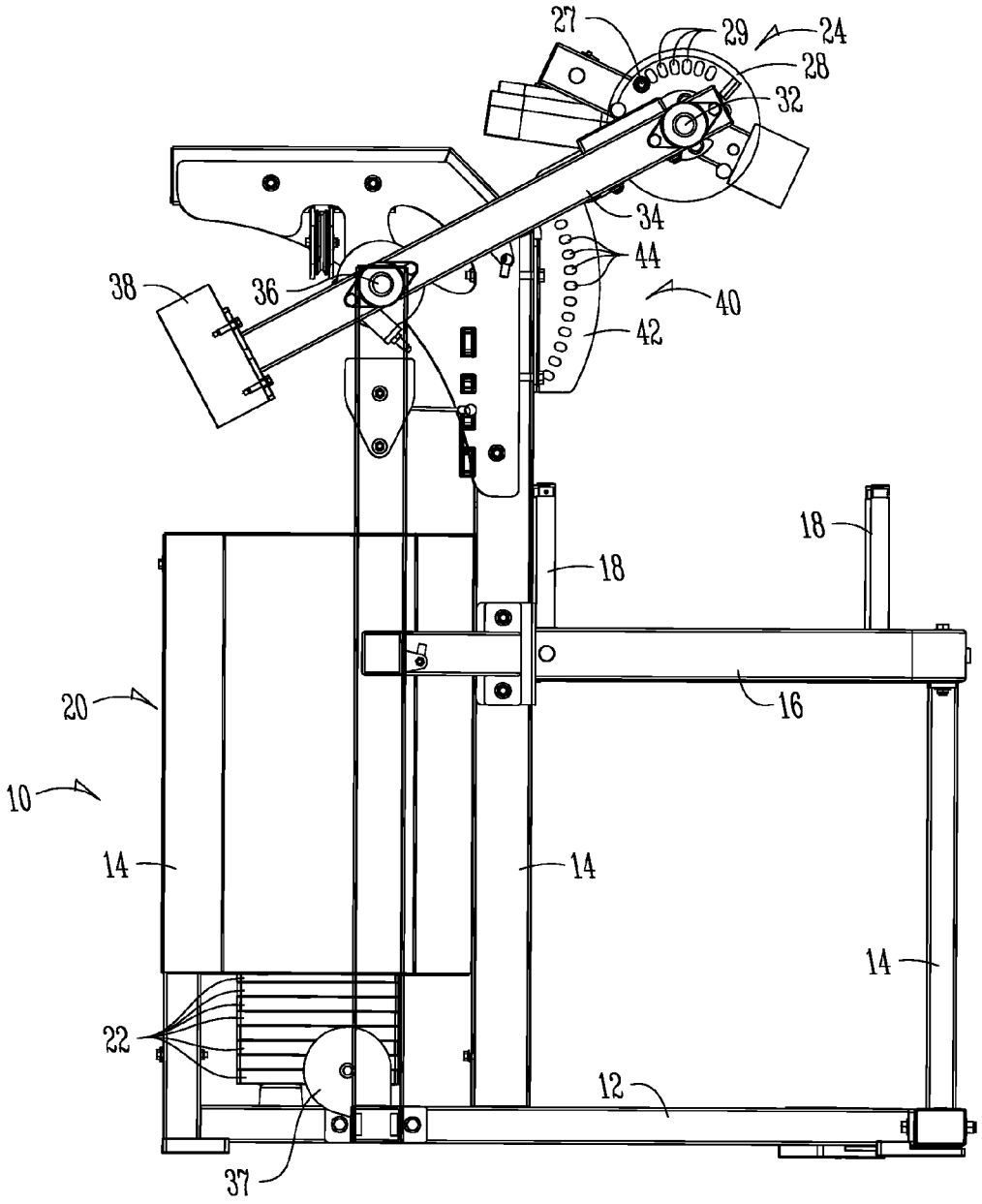
FIG. 10 is a side elevation view similar to FIG. 4, with the head pad at the highest position.
Figure 11:
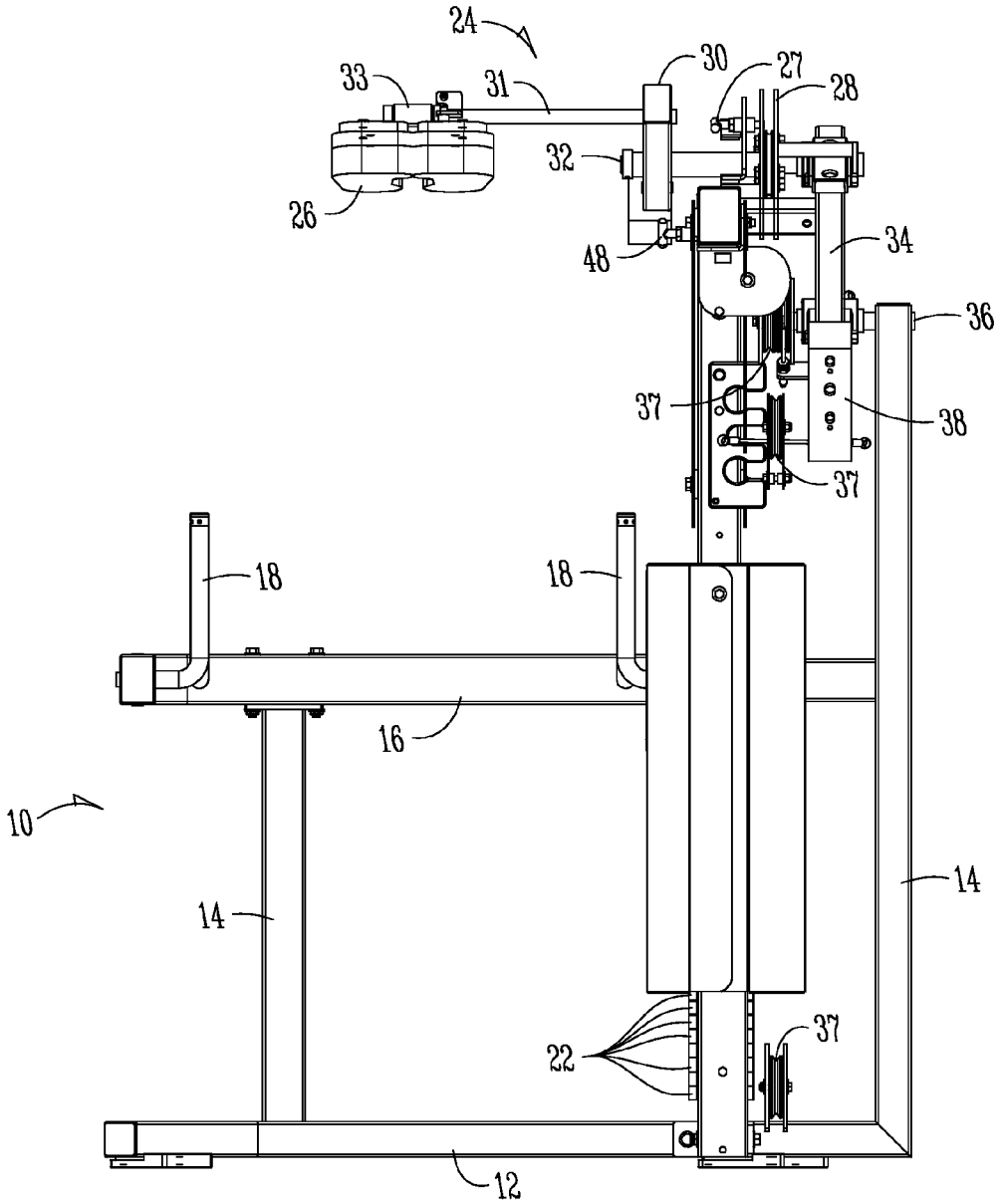
FIG. 11 is a front elevation view similar to FIG. 5, with the head pad at the highest position.

The present invention is directed towards an adjustable head pad assembly 24. More particularly, the head pad assembly 24 includes a head pad 26 connected to a cam 28 through one or more linkages 30. The cam 28 is mounted on an axle or rod near the end of an arm 34. The arm 34 is mounted by a rod or pin 36 to one of the upright posts 14, as best seen in FIG. 4. The end of the arm 34 opposite the cam 28 has a counter weight 38. The arm 31 is received in a collar or bushing 33 (FIGS. 3, 6, 7, 9 and 11) on the back of the head pad 26 which allows the head pad to rotate about the axis of arm 31 during use. Thus, the head pad 26, cam 28, and linkages 30 are pivotable about a first horizontal pivot axis defined by the rod or pin 32, while the arm 34 is rotatable about a second horizontal pivot axis defined by the rod or pin 36. The weights 22 are connected to the cam 28 via cables (not shown) and a plurality of pulleys 37. The position of the head pad 26 relative to the cam 28 can be selectively adjusted by a pin 27 inserted through one of a plurality of holes 29 in the cam, with rotation about the axis 32.

A lock assembly 40 is provided on the frame so as to selectively lock the arm 34 in a desired angular position. The lock assembly 40 includes a plate 42 affixed to one of the posts 14. The plate 42 includes a plurality of holes 44 extending along an arc. A bracket 46 extends from the arm 34 and has a pin 48 which can be selectively inserted into one of the holes 34 to lock the arm 34, and the connected head pad 26, at a desired height relative to the frame of the machine 10.

FIG. 1-6 show the head pad 26 in a lowermost position, wherein the pin 48 is in the lowest of the holes 44. FIG. 7-11 show the head pad 26 in the highest position, with the pin 48 in the highest of the holes 44. The head pad 26 can be set between the highest and lowest positions by inserting the pin 48 through one of the intermediate holes 44 in the plate 42.

In use, a person can exercise their neck in four directions, including forward, rearward, left, and right, while standing within the frame of the machine 10 with the head pad 26 positioned so that the first pivot axis 32 is at an appropriate height corresponding to the user's height. Once the arm 34 is locked in place with the pin 48 extending through one of the holes 44 in the plate 42, the start position of the head pad 26 is set, and the head pad 26 will rotate about a single axis 32, which maintains correct alignment with the neck. Thus, resistance is provided only in the direction of movement of the user's head.

In an alternative embodiment, the pivotal arm 34 is replaced with a vertically sliding assembly, such as telescoping arms, which adjustably support the head pad 26 and cam 28. A locking assembly, such as a pin in one of a series of holes is provided to maintain the head pad 26 at the selected height. In both the preferred pivotal adjustment embodiment and in the alternative vertical sliding adjustment embodiment, the height of the head pad 26 is moved up and down without moving the weight plates 22 or other resistance mechanism.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A stand-up neck exercise machine for standing use, comprising:

a frame;

a first arm pivotally mounted on the frame for movement about a first pivot axis;

a second arm mounted to the first arm and being pivotal about a second pivot axis positionable above a floor at a start height;

a head pad mounted to the second arm and being pivotal about a third pivot axis by a user's head while exercising so as to exercise a user's neck;

the start height of the second pivot axis being adjustable before a user begins a neck exercise by pivoting the first arm relative to the frame to raise and lower the second pivot axis and thereby the head pad to accommodate different height users; and wherein all three pivot axes remain horizontal while the user is exercising.

2. The neck exercise machine of claim 1 further comprising a lock assembly to selectably set the first arm at a desired angular position relative to the frame such that the height of the head pad assembly is adjustable.

3. The neck exercise machine of claim 2 wherein the lock assembly includes a first pin on the first arm and a plate on the frame with a plurality of holes to selectively receive the pin.

4. The neck exercise machine of claim 2 wherein the first arm has a counter weight on one end opposite the head pad assembly.

5. The neck exercise machine of claim 1 further comprising at least one resistance member on the frame for applying adjustable resistance to the head pad assembly.

6. The neck exercise machine of claim 1 wherein the first pivot axis is horizontal.

7. The neck exercise machine of claim 1 wherein the frame defines a standing area below the head pad.

8. The neck exercise machine of claim 1 wherein the first, second, and third pivot axes being parallel to one another.

9. A stand-up neck exercise machine for standing use, comprising:

a frame defining a standing area;

a head pad pivotally mounted on the frame for engagement by a user's head to pivot the head pad about a pair of pivot axes during a neck strengthening exercise;

a resistance mechanism on the frame to provide a resistance force to pivotal movement of the head pad;

an arm on the frame operatively connected to the head pad and pivotal about a third axis to vertically adjust the pair of pivot axes without moving the resistance mechanism so as to accommodate different height users and wherein all three pivot axes remain horizontal while the user is exercising.

10. The neck exercise machine of claim 9 further comprising a lock to prevent vertical adjustment of the head pad.

11. The neck exercise machine of claim 10 wherein the lock includes a fixed plate on the frame with a plurality of holes and a pin for selective receipt in one of the holes.

12. The neck exercise machine of claim 1 wherein the pin is movable between an extended position and a retracted position, and is spring biased to the extended position.

13. The neck exercise machine of claim 12 wherein the arm has a counter weight on one end opposite the head pad assembly.

14. The neck exercise machine of claim 11 wherein the head pad is pivotally connected to the arm.

15. The neck exercise machine of claim 9 further comprising an arm having opposite first and second ends and being pivotally mounted on the frame, with the head pad connected to one end of the arm such that pivotal movement of the arm raises and lowers the head pad.

16. The neck exercise machine of claim 9 wherein the resistance mechanism has selectively variable resistance for the head pad assembly.

17. The neck exercise machine of claim 9 wherein the head pad rotates about a horizontal axis for the vertical adjustment.

18. The neck exercise machine of claim 9 wherein the head pad has a plurality of selectable start positions and being vertically adjustable before use to one of the start positions.

19. The neck exercise machine of claim 9 wherein the three pivot axes are parallel to one another.

20. A stand-up neck exercise machine, comprising:

a frame having a resistance force and defining a standing area for a user adjacent the frame;

a head assembly having a first arm pivotal about a first horizontal axis and connected to the resistance force so as to work against the resistance force when pivoted about the first axis;

the head assembly having a pad connected to the first arm and pivotable about a second horizontal axis during use;

the head assembly having a second arm pivotally connected to the frame for rotation about a third horizontal axis and the second arm being connected to the first axis to vertically adjust the first axis to a plurality of start heights; and the first, second, and third axes being parallel to one another.

21. The stand-up neck exercise machine of claim 20 further comprising a lock mechanism to lock the first axis at one of the start heights.

* * * * *